US008323010B2

(12) United States Patent
Oyagi et al.

(10) Patent No.: US 8,323,010 B2
(45) Date of Patent: Dec. 4, 2012

(54) EXPANDER-COMPRESSOR UNIT

(75) Inventors: Shingo Oyagi, Osaka (JP); Takeshi Ogata, Osaka (JP); Takumi Hikichi, Osaka (JP); Masanobu Wada, Osaka (JP); Yu Shiotani, Osaka (JP)

(73) Assignee: Panasonic Corporation, Osaka (JP)

( * ) Notice: Subject to any disclaimer, the term of this patent is extended or adjusted under 35 U.S.C. 154(b) by 210 days.

(21) Appl. No.: 12/743,679

(22) PCT Filed: Oct. 9, 2008

(86) PCT No.: PCT/JP2008/002858

§ 371 (c)(1),
(2), (4) Date: May 19, 2010

(87) PCT Pub. No.: WO2009/066410

PCT Pub. Date: May 28, 2009

(65) Prior Publication Data

US 2010/0254844 A1 Oct. 7, 2010

(30) Foreign Application Priority Data

Nov. 21, 2007 (JP) ..... 2007-301433

(51) Int. Cl.

| | |
|---|---|
| ***F01C 21/04*** | (2006.01) |
| ***F01C 21/06*** | (2006.01) |
| ***F03C 2/00*** | (2006.01) |
| ***F03C 4/00*** | (2006.01) |
| ***F04C 2/00*** | (2006.01) |
| ***F04C 15/00*** | (2006.01) |
| ***F04C 27/02*** | (2006.01) |
| ***F04C 29/02*** | (2006.01) |
| ***F04C 29/04*** | (2006.01) |

(52) U.S. Cl. ..... 418/94; 417/373; 417/410.5

(58) Field of Classification Search ..... 417/373, 417/374, 410.5; 184/6.11, 6.21, 6.22; 418/3, 418/55.6, 83, 85, 88, 91, 92, 94; 62/402, 62/403, 468

See application file for complete search history.

(56) References Cited

U.S. PATENT DOCUMENTS

| | | | | | |
|---|---|---|---|---|---|
| 3,848,702 | A | * | 11/1974 | Bergman | 184/6.3 |
| 4,846,640 | A | * | 7/1989 | Nishida et al. | 418/55.6 |
| 4,865,530 | A | * | 9/1989 | Nishida et al. | 418/55.6 |
| 5,214,932 | A | * | 6/1993 | Abdelmalek | 62/238.4 |
| 5,263,822 | A | * | 11/1993 | Fujio | 418/55.4 |
| 5,358,392 | A | * | 10/1994 | Ukai | 418/55.6 |
| 5,520,526 | A | * | 5/1996 | Fujio | 418/55.4 |

(Continued)

FOREIGN PATENT DOCUMENTS

EP 1 918 510 A1 5/2008

(Continued)

*Primary Examiner* — Devon Kramer
*Assistant Examiner* — Christopher Maxey
(74) *Attorney, Agent, or Firm* — Hamre, Schumann, Mueller & Larson, P.C.

(57) ABSTRACT

An expander-compressor unit (200) includes a closed casing (1), a compression mechanism (2) disposed at an upper position in the closed casing (1), an expansion mechanism (3) disposed at a lower position in the closed casing (1), a shaft (5) coupling the compression mechanism (2) to the expansion mechanism (3), and an oil pump (6) disposed between the compression mechanism (2) and the expansion mechanism (3). The oil pump (6) supplies the oil held in an oil reservoir (25) to the compression mechanism (2) via a suction passage. A strainer (65) is provided to the suction passage so that the oil to be drawn into the oil pump (6) passes through the strainer.

8 Claims, 11 Drawing Sheets

U.S. PATENT DOCUMENTS

| | | | | |
|---|---|---|---|---|
| 5,616,019 | A | 4/1997 | Hattori et al. | |
| 5,660,539 | A * | 8/1997 | Matsunaga et al. | 418/55.6 |
| 5,775,883 | A * | 7/1998 | Hattori et al. | 417/310 |
| 6,098,753 | A * | 8/2000 | Lamarre et al. | 184/6.11 |
| 6,116,877 | A * | 9/2000 | Takeuchi et al. | 418/88 |
| 7,628,592 | B2 * | 12/2009 | Okamoto et al. | 418/3 |
| 7,717,688 | B2 * | 5/2010 | Yoo et al. | 418/88 |
| 7,771,180 | B2 * | 8/2010 | Cho et al. | 418/55.6 |
| 7,896,627 | B2 * | 3/2011 | Okamoto et al. | 418/13 |
| 8,033,135 | B2 * | 10/2011 | Okaichi et al. | 62/468 |
| 8,087,260 | B2 * | 1/2012 | Ogata et al. | 62/401 |
| 2006/0204378 | A1 * | 9/2006 | Anderson | 417/410.5 |
| 2008/0232992 | A1 | 9/2008 | Okamoto et al. | |
| 2009/0007590 | A1 * | 1/2009 | Sakitani et al. | 62/513 |
| 2009/0139262 | A1 | 6/2009 | Takahashi et al. | |
| 2009/0282845 | A1 * | 11/2009 | Hasegawa et al. | 62/87 |
| 2010/0003147 | A1 * | 1/2010 | Takahashi et al. | 417/405 |
| 2010/0089092 | A1 * | 4/2010 | Hasegawa et al. | 62/498 |
| 2010/0107680 | A1 * | 5/2010 | Ogata et al. | 62/468 |
| 2010/0132398 | A1 * | 6/2010 | Takahashi et al. | 62/468 |
| 2010/0162750 | A1 * | 7/2010 | Okaichi et al. | 62/498 |
| 2010/0186439 | A1 * | 7/2010 | Ogata et al. | 62/402 |
| 2010/0202909 | A1 * | 8/2010 | Shiotani et al. | 418/3 |
| 2010/0263404 | A1 * | 10/2010 | Shiotani et al. | 62/468 |
| 2010/0269536 | A1 * | 10/2010 | Wada et al. | 62/402 |
| 2010/0275638 | A1 * | 11/2010 | Hasegawa et al. | 62/402 |
| 2011/0138831 | A1 * | 6/2011 | Ogata et al. | 62/193 |
| 2011/0302954 | A1 * | 12/2011 | Okaichi et al. | 62/468 |

FOREIGN PATENT DOCUMENTS

| | | | | |
|---|---|---|---|---|
| EP | 1 965 022 | A1 | | 9/2008 |
| EP | 2 020 483 | A1 | | 2/2009 |
| JP | 8-028461 | A | | 1/1996 |
| JP | 8-082296 | A | | 3/1996 |
| JP | 08086289 | A | * | 4/1996 |
| JP | 9-126171 | A | | 5/1997 |
| JP | 10266980 | A | * | 10/1998 |
| JP | 2003-139059 | A | | 5/2003 |
| JP | 2005-299632 | A | | 10/2005 |
| JP | 2006132377 | A | * | 5/2006 |
| JP | 2006-283590 | A | | 10/2006 |
| JP | 2007315227 | A | * | 12/2007 |
| JP | 2008-008165 | A | | 1/2008 |
| JP | 2008-215212 | A | | 9/2008 |
| JP | 2008-240550 | A | | 10/2008 |
| WO | WO 2007/000854 | A1 | | 1/2007 |
| WO | WO 2007/132649 | A1 | | 11/2007 |
| WO | WO 2008/087795 | A1 | | 7/2008 |

* cited by examiner

EXPANDER-COMPRESSOR UNIT

TECHNICAL FIELD

The present invention relates to an expander-compressor unit including a compression mechanism for compressing a fluid and an expansion mechanism for expanding the fluid.

BACKGROUND ART

As an example of fluid machines having an expansion mechanism and a compression mechanism, an expander-compressor unit conventionally has been known. FIG. 13 is a vertical cross-sectional view of an expander-compressor unit described in JP 2005-299632 A.

An expander-compressor unit 103 includes a closed casing 120, a compression mechanism 121, a motor 122, and an expansion mechanism 123. A shaft 124 couples the motor 122, the compression mechanism 121, and the expansion mechanism 123. The expansion mechanism 123 recovers power from a working fluid (such as a refrigerant) expanding, and provides the recovered power to the shaft 124. Thereby, the power consumption of the motor 122 for driving the compression mechanism 121 is reduced, and the coefficient of performance of a system using the expander-compressor unit 103 is increased.

The closed casing 120 has a bottom portion 125 utilized as an oil reservoir. An oil pump 126 is provided at a lower end of the shaft 124 in order to pump up an oil held in the bottom portion 125 to an upper part of the closed casing 120. The oil pumped up by the oil pump 126 is supplied to the compression mechanism 121 and the expansion mechanism 123 via an oil supply passage 127 formed in the shaft 124. Thereby, lubrication and sealing are ensured in sliding parts of the compression mechanism 121 and those of the expansion mechanism 123.

An oil return passage 128 is provided at an upper part of the expansion mechanism 123. One end of the oil return passage 128 is connected to the oil supply passage 127 formed in the shaft 124, and the other end thereof opens downwardly below the expansion mechanism 123. Generally, the oil is supplied excessively for ensuring the reliability of the expansion mechanism 123. The excess oil is discharged downwardly below the expansion mechanism 123 via the oil return passage 128.

Usually, the amount of the oil contained in the working fluid is different between the compression mechanism 121 and the expansion mechanism 123. Thus, in the case where the compression mechanism 121 and the expansion mechanism 123 are accommodated in separate closed casings, a means for adjusting the amount of the oil in the two closed casings is essential in order to prevent the amount of the oil from being excess or deficient. In contrast, the expander-compressor unit 103 shown in FIG. 13 intrinsically is free from the problem of the excess or deficient oil amount because the compression mechanism 121 and the expansion mechanism 123 are accommodated in the same closed casing 120.

In the expander-compressor unit 103, the oil pumped up from the bottom portion 125 is heated by the compression mechanism 121 because the oil passes through the compression mechanism 121 having a high temperature. The oil heated by the compression mechanism 121 is heated further by the motor 122 and reaches the expansion mechanism 123. The oil that has reached the expansion mechanism 123 is cooled by the expansion mechanism 123 having a low temperature, and thereafter is discharged downwardly below the expansion mechanism 123 via the oil return passage 128. The oil discharged from the expansion mechanism 123 is heated when passing along a side face of the motor 122. The oil is heated further also when passing along a side face of the compression mechanism 121, and returns to the bottom portion 125 of the closed casing 120.

As described above, the oil circulates between the compression mechanism and the expansion mechanism so that the heat is transferred from the compression mechanism to the expansion mechanism via the oil. This heat transfer lowers the temperature of the working fluid discharged from the compression mechanism and raises the temperature of the working fluid discharged from the expansion mechanism, hindering the increase in the coefficient of performance of the system using the expander-compressor unit.

DISCLOSURE OF INVENTION

The present invention has been accomplished in view of the foregoing. The present invention is intended to suppress the heat transfer from a compression mechanism to an expansion mechanism in an expander-compressor unit.

In order to achieve the above-mentioned object, the present inventors proposed, in International Application PCT/JP2007/058871 (filing date Apr. 24, 2007, priority date May 17, 2006) preceding the present application, an expander-compressor unit including: a closed casing having a bottom portion utilized as an oil reservoir; a compression mechanism disposed in the closed casing so as to be located above or below an oil level of an oil held in the oil reservoir; an expansion mechanism disposed in the closed casing so that a positional relationship of the expansion mechanism with respect to the oil level is vertically opposite to that of the compression mechanism; a shaft coupling the compression mechanism and the expansion mechanism; and an oil pump disposed between the compression mechanism and the expansion mechanism and configured to supply the oil filling a surrounding space of the compression mechanism or the expansion mechanism to the compression mechanism or the expansion mechanism located above the oil level.

In the above-mentioned expander-compressor unit, it is required to prevent the entry of foreign matters into the oil pump in order to allow the oil pump to supply the oil stably. The present invention has been accomplished in view of such a circumstance.

More specifically, the present invention provides an expander-compressor unit including: a closed casing having a bottom portion utilized as an oil reservoir; a compression mechanism disposed in the closed casing so as to be located above or below an oil level of an oil held in the oil reservoir; an expansion mechanism disposed in the closed casing so that a positional relationship of the expansion mechanism with respect to the oil level is vertically opposite to that of the compression mechanism; a shaft coupling the compression mechanism to the expansion mechanism; an oil pump disposed between the compression mechanism and the expansion mechanism and configured to draw the oil held in the oil reservoir via a suction passage and supply the oil to one of the compression mechanism and the expansion mechanism that is located above the oil level; and a strainer provided to the suction passage so that the oil to be drawn into the oil pump passes through the strainer.

In the above-mentioned configuration, the oil pump is disposed between the compression mechanism and the expansion mechanism, and thus the oil drawn into the oil pump is supplied to the upper-located mechanism without passing through the lower-located mechanism. As a result, the heat transfer from the compression mechanism to the expansion mechanism via the oil is suppressed.

Furthermore, in the configuration of the present invention, the strainer is provided to the suction passage, and thus the entry of foreign matters into the oil pump can be prevented. Accordingly, the oil pump can supply the oil stably.

BEST MODE FOR CARRYING OUT THE INVENTION

Hereinbelow, embodiments of the present invention will be described with reference to the accompanying drawings.

Figure 1:
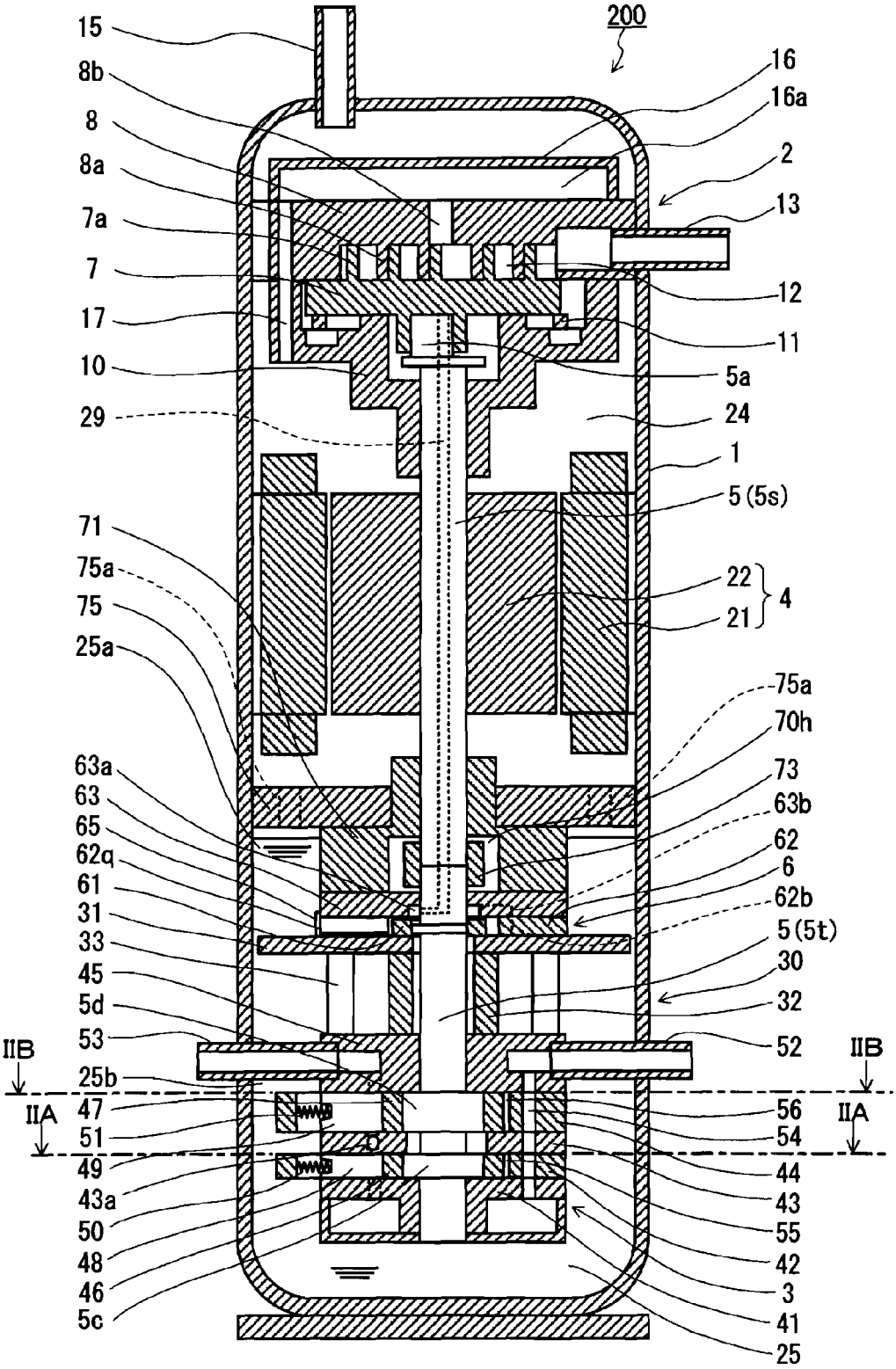
FIG. 1 is a vertical cross-sectional view of an expander-compressor unit according to one embodiment of the present invention.
Figure 2A:
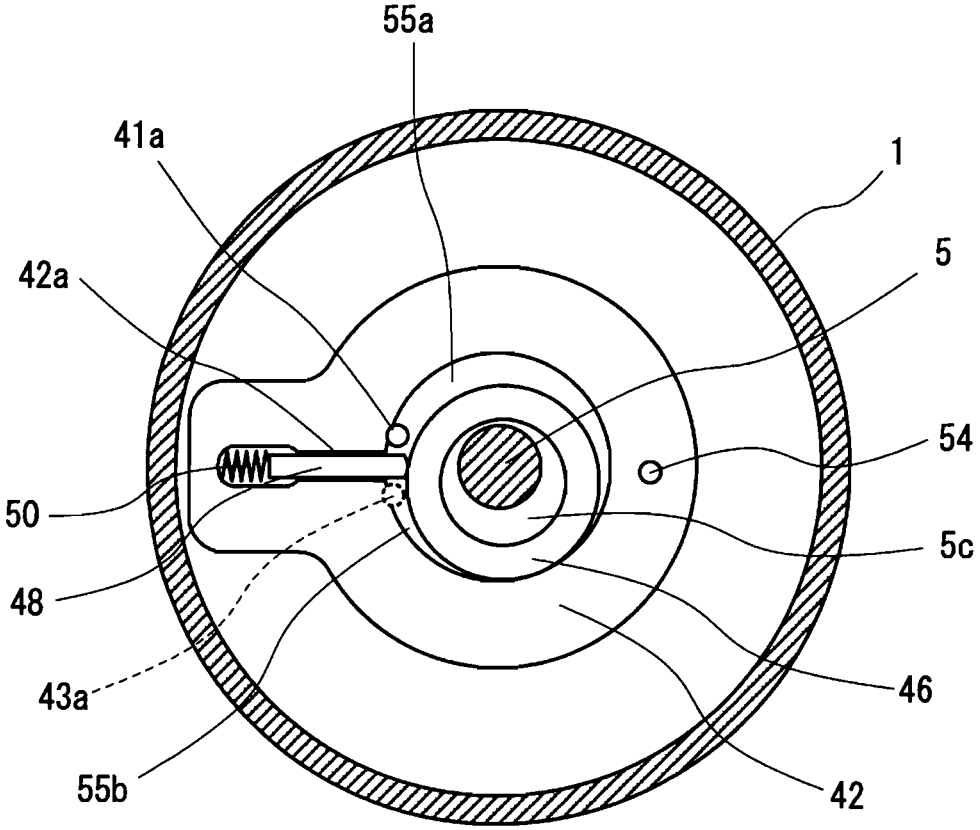
FIG. 2A is a transverse cross-sectional view of the expander-compressor unit shown in FIG. 1 taken along the line IIA-IIA.
Figure 2B:
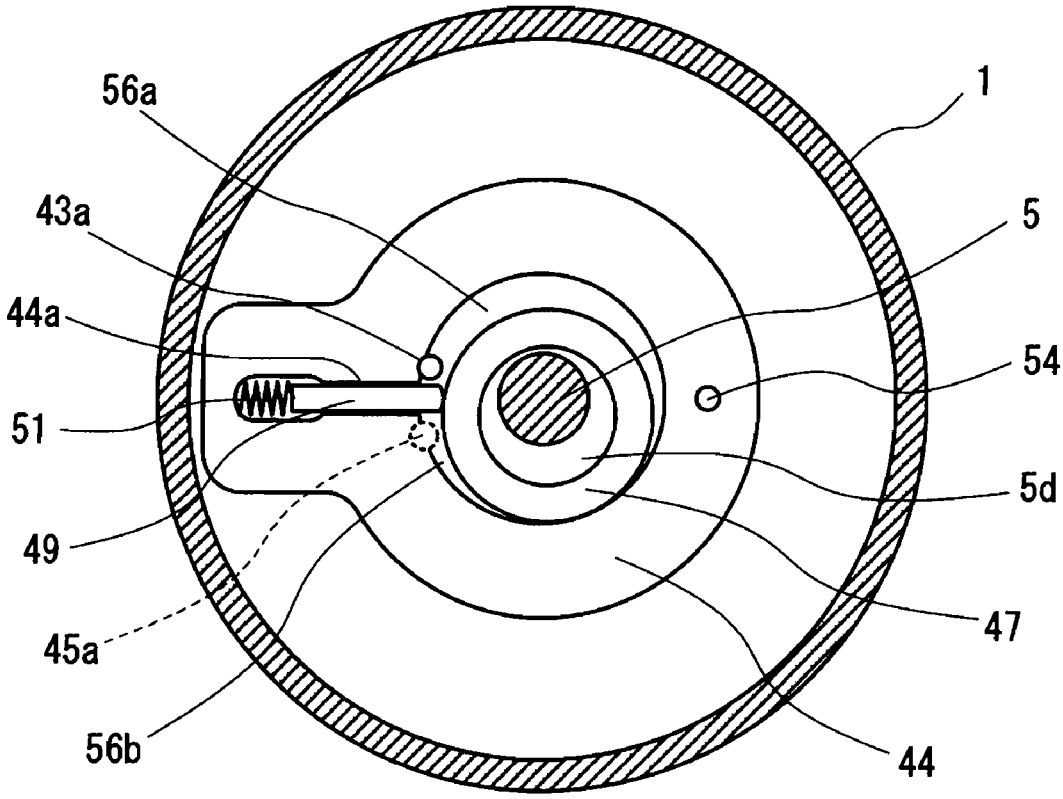
FIG. 2B is a transverse cross-sectional view taken along the line IIB-IIB in the same manner.
Figure 3:
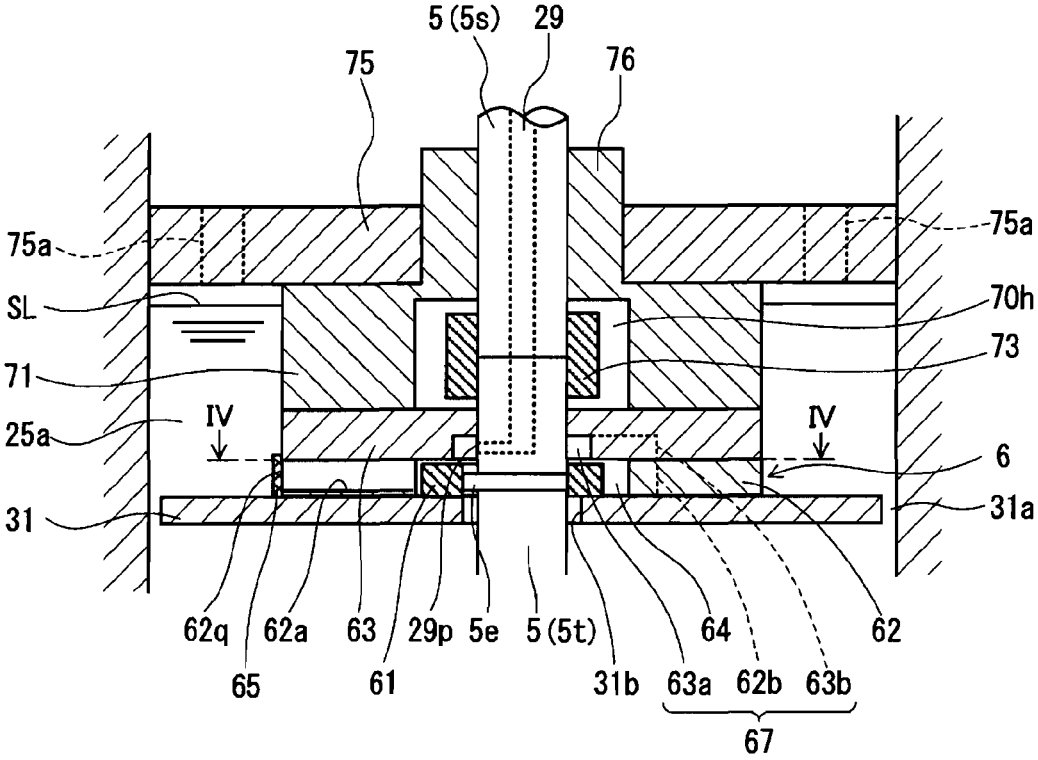
FIG. 3 is a partially enlarged view of FIG. 1.

FIG. 1 is a vertical cross-sectional view of one expander-compressor unit according to an embodiment of the present invention. FIG. 2A is a transverse cross-sectional view of the expander-compressor unit shown in FIG. 1 taken along the line IIA-IIA. FIG. 2B is a transverse cross-sectional view of the expander-compressor unit shown in FIG. 1 taken along the line IIB-IIB. FIG. 3 is a partially enlarged view of FIG. 1.

As shown in FIG. 1, an expander-compressor unit 200 includes a closed casing 1, a scroll-type compression mechanism 2 disposed at an upper position in the closed casing 1, a two-stage rotary-type expansion mechanism 3 disposed at a lower position in the closed casing 1, a motor 4 disposed between the compression mechanism 2 and the expansion mechanism 3, a shaft 5 coupling the compression mechanism 2, the expansion mechanism 3, and the motor 4, an oil pump 6 disposed between the motor 4 and the expansion mechanism 3, and a partition member 31 disposed between the expansion mechanism 3 and the oil pump 6. The motor 4 drives the shaft 5 so as to operate the compression mechanism 2. The expansion mechanism 3 recovers power from a working fluid expanding and applies it to the shaft 5 to assist the driving of the shaft 5 by the motor 4. The working fluid is, for example, a refrigerant such as carbon dioxide and hydrofluorocarbon.

In this description, an axial direction of the shaft 5 is defined as a vertical direction, a side on which the compression mechanism 2 is disposed is defined as an upper side, and a side on which the expansion mechanism 3 is disposed is defined as a lower side. However, the positions of the compression mechanism 2 and the expansion mechanism 3 may be opposite to those in the present embodiment. More specifically, an embodiment is conceivable in which the compression mechanism 2 is located on the lower side and the expansion mechanism 3 is located on the upper side. Furthermore, although the scroll-type compression mechanism 2 and the rotary-type expansion mechanism 3 are employed in the present embodiment, the types of the compression mechanism 2 and the expansion mechanism 3 are not limited to these. They may be another type of positive displacement mechanism. For example, both of the compression mechanism and the expansion mechanism may be the rotary-type or the scroll-type.

As shown in FIG. 1, the closed casing 1 has a bottom portion utilized as an oil reservoir 25, and an internal space 24 above the oil reservoir is filled with the working fluid. Oil is used for ensuring lubrication and sealing of sliding parts of the compression mechanism 2 and the expansion mechanism 3. The amount of the oil held in the oil reservoir 25 is adjusted so that an oil level SL (see FIG. 3) is present above an oil suction port 62*q* of the oil pump 6 and below the motor 4 in a state where the closed casing 1 is placed upright, i.e., in a state where the posture of the closed casing 1 is determined so that the axial direction of the shaft 5 is parallel to the vertical direction. In other words, the locations of the oil pump 6 and the motor 4, and the shape and size of the closed casing 1 for accommodating these elements are determined so that the oil level of the oil is present between the oil suction port 62*q* of the oil pump 6 and the motor 4.

The oil reservoir 25 includes an upper tank 25*a* in which the oil suction port 62*q* of the oil pump 6 is located and a lower tank 25*b* in which the expansion mechanism 3 is located. The upper tank 25*a* and the lower tank 25*b* are separated from each other by the partition member 31. A surrounding space of the oil pump 6 is filled with the oil held in the upper tank 25*a*. The expansion mechanism 3 is immersed in the oil held in the lower tank 25*b*. The oil held in the upper tank 25*a* is used mainly for the compression mechanism 2 located above the oil level SL, and the oil held in the lower tank 25*b* is used mainly for the expansion mechanism 3 located below the oil level SL (more specifically, below the partition member 31).

The oil pump 6 is disposed between the compression mechanism 2 and the expansion mechanism 3 in the axial direction of the shaft 5 so that the oil level of the oil held in the upper tank 25*a* is present above the oil suction port 62*q*. A support frame 75 is disposed between the motor 4 and the oil pump 6. The support frame 75 is fixed to the closed casing 1. The oil pump 6, the partition member 31, and the expansion mechanism 3 are fixed to the closed casing 1 via the support frame 75. A plurality of through holes 75*a* are provided in an outer peripheral portion of the support frame 75 so that the oil that lubricated the compression mechanism 2 and the oil that has been separated from the working fluid discharged to the internal space 24 of the closed casing 1 can return to the upper tank 25*a*. The number of the through hole 75*a* may be one.

The oil held in the upper tank 25*a* is drawn into the oil pump 6 and supplied to the sliding parts of the compression mechanism 2. The oil returning to the upper tank 25*a* via the through holes 75*a* of the support frame 75 after lubricating the compression mechanism 2 has a relatively high temperature because it has been heated by the compression mechanism 2 and the motor 4. The oil that has returned to the upper tank 25*a* is drawn into the oil pump 6 again. On the other hand, the oil held in the lower tank 25*b* is supplied to the sliding parts of the expansion mechanism 3. The oil that lubricated the sliding parts of the expansion mechanism 3 is returned directly to the lower tank 25*b*. The oil held in the lower tank 25*b* has a relatively low temperature because it has been cooled by the expansion mechanism 3. By disposing the oil pump 6 between the compression mechanism 2 and the expansion mechanism 3 and supplying the oil to the compression mechanism 2 by using the oil pump 6, it is possible to keep a circulation passage for the high temperature oil lubricating the compression mechanism 2 away from the expansion mechanism 3. In other words, the circulation passage for the high temperature oil lubricating the compression mechanism 2 can be separated from a circulation passage for the low temperature oil lubricating the expansion mechanism 3. Thereby, the heat transfer from the compression mechanism 2 to the expansion mechanism 3 via the oil is suppressed.

Although the effect of suppressing the heat transfer can be obtained with only the oil pump 6 disposed between the compression mechanism 2 and expansion mechanism 3, the addition of the partition member 31 can enhance this effect significantly.

When the expander-compressor unit 200 is being operated, the oil held in the oil reservoir 25 has a relatively high temperature in the upper tank 25*a* and has a relatively low temperature in a surrounding space of the expansion mechanism 3 located in the lower tank 25*b*. The partition member 31 restricts a flow of the oil between the upper tank 25*a* and the lower tank 25*b*, and thus the state in which the high temperature oil is held in the upper tank 25*a* and the low temperature oil is held in the lower tank 25*b* is maintained. Furthermore, the presence of an after-mentioned heat insulating structure 30 including the partition member 31 increases a distance between the oil pump 6 and the expansion mechanism 3 in the axial direction. This also makes it possible to reduce the amount of the heat transfer from the oil filling the surrounding space of the oil pump 6 to the expansion mechanism 3. The flow of the oil between the upper tank 25*a* and the lower tank 25*b* is restricted but not prohibited by the partition member 31. The flow of the oil from the upper tank 25*a* to the lower tank 25*b* and vice versa can occur so as to balance the oil amount.

In the present embodiment, the partition member 31 is in the shape of a disk slightly smaller than a cross section of the internal space 24 of the closed casing 1, and a slight amount of the oil is allowed to flow through a gap 31*a* (see FIG. 3) formed between an end face of the partition member 31 and an inner circumferential surface of the closed casing 1. The partition member 31 has, at a center thereof, a through hole 31*b* (see FIG. 3) for allowing the shaft 5 to extend therethrough. Although the diameter of the through hole 31*b* is set slightly larger than that of the shaft 5 in the present embodiment, it may be set equivalent to the diameter of the shaft 5.

The partition member 31 is not limited as long as it serves to separate the upper tank 25*a* and the lower tank 25*b* from each other and restrict the flow of the oil therebetween. The shape and configuration of the partition member 31 can be selected appropriately. For example, it also is possible that the partition member 31 has a diameter equal to an inner diameter of the closed casing 1, and the partition member 31 is provided with a through hole or a cut out from the end face for allowing the oil to flow therethrough. Alternatively, the partition member 31 may be formed into a hollow shape (for example, a reel shape) with a plurality of components so that the oil can be held therein temporarily.

A plurality of spacers 33 that function as columns and a shaft cover 32 are disposed between the partition member 31 and the expansion mechanism 3. The heat insulating structure 30 is composed of the spacers 33 and the partition member 31. The spacers 33 form a space filled with the oil held in the lower tank 25*b* between the partition member 31 and the expansion mechanism 3. The oil itself filling the space ensured by the spacers 33 serves as a heat insulator and forms a thermal stratification in the axial direction. The shaft cover 32 has a circular cylindrical shape covering the shaft 5 in the space ensured by the spacers 33.

Next, the compression mechanism 2 and the expansion mechanism 3 will be described.

The scroll-type compression mechanism 2 includes an orbiting scroll 7, a stationary scroll 8, an Oldham ring 11, a bearing member 10, and a muffler 16. A suction pipe 13 extending from outside to inside of the closed casing 1 is connected to the stationary scroll 8. The orbiting scroll 7 is fitted with an eccentric pivot 5*a* of the shaft 5, and the self-rotation of the orbiting scroll 7 is restrained by the Oldham ring 11. The orbiting scroll 7, with a spiral shaped lap 7*a* thereof meshing with a lap 8*a* of the stationary scroll 8, scrolls in association with the rotation of the shaft 5. A crescent-shaped working chamber 12 formed between the laps 7*a* and 8*a* moves from outside to inside so as to reduce its volumetric capacity, and thereby the working fluid drawn from the suction pipe 13 is compressed. The compressed working fluid passes through a discharge port 8*b* provided at a center of the stationary scroll 8, an internal space 16*a* of the muffler 16, and a flow passage 17 penetrating through the stationary scroll 8 and the bearing member 10, in this order. The working fluid then is discharged to the internal space 24 of the closed casing 1. The oil that has reached the compression mechanism 2 via an oil supply passage 29 formed in the shaft 5 lubricates sliding surfaces between the orbiting scroll 7 and the eccentric pivot 5*a* and sliding surfaces between the orbiting scroll 7 and the stationary scroll 8. The working fluid discharged to the internal space 24 of the closed casing 1 is separated from the oil by a gravitational force or a centrifugal force while staying in the internal space 24. Thereafter, the working fluid is discharged through a discharge pipe 15 provided at the upper part of the closed casing 1 to a gas cooler.

The motor 4 for driving the compression mechanism 2 via the shaft 5 includes a stator 21 fixed to the closed casing 1 and a rotor 22 fixed to the shaft 5. Electric power is supplied from a terminal (not shown) disposed at the upper part of the closed casing 1 to the motor 4. The motor 4 may be either a synchronous machine or an induction machine. The motor 4 is cooled by the working fluid discharged from the compression mechanism 2 and the oil contained in the working fluid.

The oil supply passage 29 leading to the sliding parts of the compression mechanism 2 is formed in the shaft 5 so as to extend in the axial direction. The shaft 5 is provided with an introduction inlet 29*p* (see FIG. 3) for introducing the oil into the oil supply passage 29, at a position corresponding to the oil pump 6. The oil is fed into the oil supply passage 29 from the oil pump 6 via the introduction inlet 29*p*. The oil fed into the oil supply passage 29 is supplied to each of the sliding parts of the compression mechanism 2 without passing through the expansion mechanism 3. With such a configuration, the heat transfer from the compression mechanism 2 to the expansion mechanism 3 via the oil can be suppressed effectively because the oil flowing toward the compression mechanism 2 is not cooled by the expansion mechanism 3. Moreover, the formation of the oil supply passage 29 in the shaft 5 is desirable because neither an increase in the parts count nor a problem of layout of the parts arises additionally.

Furthermore, in the present embodiment, the shaft 5 is composed of a first shaft 5*s* located on a side of the compression mechanism 2 and a second shaft 5*t* located on a side of the expansion mechanism 3. The oil supply passage 29 is formed across these shafts 5*s* and 5*t*. The first shaft 5*s* and the second shaft 5*t* are coupled to each other with a coupler 73 so that the power recovered by the expansion mechanism 3 is transferred to the compression mechanism 2. However, the first shaft 5*s* and the second shaft 5*t* may be engaged directly to each other without using the coupler 73. Furthermore, it also is possible to use a shaft formed of a single component.

The expansion mechanism 3 includes a first cylinder 42, a second cylinder 44 with a larger thickness than that of the first cylinder 42, and an intermediate plate 43 for separating the cylinders 42 and 44 from each other. The first cylinder 42 and the second cylinder 44 are disposed concentrically with each other. The expansion mechanism 3 further includes: a first piston 46 that allows an eccentric portion 5*c* of the shaft 5 to be fitted thereinto and performs eccentric rotational motion in the first cylinder 42; a first vane 48 that is retained reciprocably in a vane groove 42*a* (see FIG. 2A) of the first cylinder 42 and is in contact with the first piston 46 at one end; a first spring 50 that is in contact with the other end of the first vane 48 and pushes the first vane 48 toward the first piston 46; a second piston 47 that allows an eccentric portion 5*d* of the shaft 5 to be fitted thereinto and performs eccentric rotational motion in the second cylinder 44; a second vane 49 that is retained reciprocably in a vane groove 44*a* (see FIG. 2B) of the second cylinder 44 and is in contact with the second piston 47 at one end; and a second spring 51 that is in contact with the other end of the second vane 49 and pushes the second vane 49 toward the second piston 47.

The expansion mechanism 3 further includes an upper bearing member 45 and a lower bearing member 41 disposed so as to sandwich the first cylinder 42, the second cylinder 44, and the intermediate plate 43 therebetween. The intermediate plate 43 and the lower bearing member 41 sandwich the first cylinder 42 from the top and bottom, and the upper bearing member 45 and the intermediate plate 43 sandwich the second cylinder 44 from the top and bottom. Sandwiching the first cylinder 42 and the second cylinder 44 by the upper bearing member 45, the intermediate plate 43, and the lower bearing member 41 forms, in the first cylinder 42 and the second cylinder 44, working chambers whose volumetric capacities vary in accordance with the rotations of the pistons 46 and 47. The upper bearing member 45 and the lower bearing member 41 function also as bearing members for supporting the shaft 5 rotatably. Moreover, a suction pipe 52 extending from the outside to the inside of the closed casing 1 and a suction pipe 53 extending from the inside to the outside of the closed casing 1 are connected to the upper bearing member 45.

As shown in FIG. 2A, a suction-side working chamber 55*a* (first suction-side space) and a discharge-side working chamber 55*b* (first discharge-side space) are formed in the first cylinder 42. The suction-side working chamber 55*a* and the discharge-side working chamber 55*b* are demarcated by the first piston 46 and the first vane 48. As shown in FIG. 2B, a suction-side working chamber 56*a* (second suction-side space) and a discharge-side working chamber 56*b* (second discharge-side space) are formed in the second cylinder 44. The suction-side working chamber 56*a* and the discharge-side working chamber 56*b* are demarcated by the second piston 47 and the second vane 49. The total volumetric capacity of the two working chambers 56*a* and 56*b* in the second cylinder 44 is larger than the total volumetric capacity of the two working chambers 55*a* and 55*b* in the first cylinder 42. The discharge-side working chamber 55*b* in the first cylinder 42 and the suction-side working chamber 56*a* of the second cylinder 44 are connected to each other via a through hole 43*a* provided in the intermediate plate 43 so as to function as a single working chamber (expansion chamber). The working fluid having a high pressure flows from the suction pipe 52 into the working chamber 55*a* of the first cylinder 42 via a suction passage 54 penetrating through the second cylinder 44, the intermediate plate 43, the first cylinder 42 and the lower bearing member 41, and a suction port 41*a* provided in the lower bearing member 41. The working fluid that has flowed into the working chamber 55*a* of the first cylinder 42 expands and reduces its pressure in the expansion chamber composed of the working chambers 55*a* and 55*b* while rotating the shaft 5. The pressure-reduced working fluid is discharged to the discharge pipe 53 via a discharge port 45*a* provided in the upper bearing member 45.

As described above, the expansion mechanism 3 is a rotary-type mechanism including: the cylinders 42 and 44; the pistons 46 and 47 disposed in the cylinders 42 and 44 so that the eccentric portions 5*c* and 5*d* of the shaft 5 are fitted thereinto, respectively; and the bearing members 41 and 45 (closing members) that close the cylinders 42 and 44, respectively, and form the expansion chamber together with the cylinders 42 and 44 and the pistons 46 and 47. In a rotary-type fluid mechanism, it is necessary to lubricate a vane that partitions a space in the cylinder into two spaces due to its structural limitations. When the entire mechanism is immersed in the oil, the vane can be lubricated in a remarkably simple manner, specifically, by exposing a rear end of the vane groove in which the vane is disposed to an interior of the closed casing 1. The vanes 48 and 49 are lubricated in such a manner also in the present embodiment.

Figure 5:
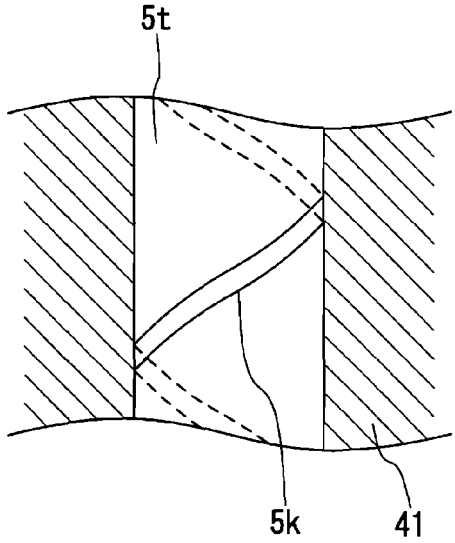
FIG. 5 is a schematic view showing an oil supply groove formed in an outer circumferential surface of a lower shaft.

The oil supply to other parts (the bearing members 41 and 45, for example) can be performed by, for example, forming a groove 5*k* in an outer circumferential surface of the second shaft 5*t* so as to extend from a lower end of the second shaft 5*t* toward the cylinders 42 and 44 of the expansion mechanism 3, as shown in FIG. 5. The pressure applied to the oil held in the oil reservoir 25 is higher than the pressure applied to the oil that is lubricating the cylinders 42 and 44 and the pistons 46 and 47. Thus, the oil can be supplied to the sliding parts of the expansion mechanism 3 by flowing through the groove 5*k* formed in the outer circumferential surface of the second shaft 5*t* without the aid of the oil pump.

Next, the oil pump 6 and the configuration around it will be described in detail.

As shown in FIG. 3, the oil pump 6 is a positive displacement pump configured to pump the oil by an increase or decrease in the volumetric capacity of the working chamber as the shaft 5 rotates. A relay member 71 is disposed above the oil pump 6. The shaft 5 penetrates through a center of the relay member 71. The oil pump 6 is fixed to the support frame 75 via the relay member 71.

The relay member 71 has an internal space 70*h* for accommodating the coupler 73, and a bearing portion 76 for supporting the shaft 5 (the first shaft 5*s*). In other words, the relay member 71 serves as a housing for the coupler 73 as well as a bearing for the shaft 5. The support frame 75 may have a portion equivalent to the bearing portion 76. Furthermore, the support frame 75 and the relay member 71 may be formed of a single component.

Figure 4:
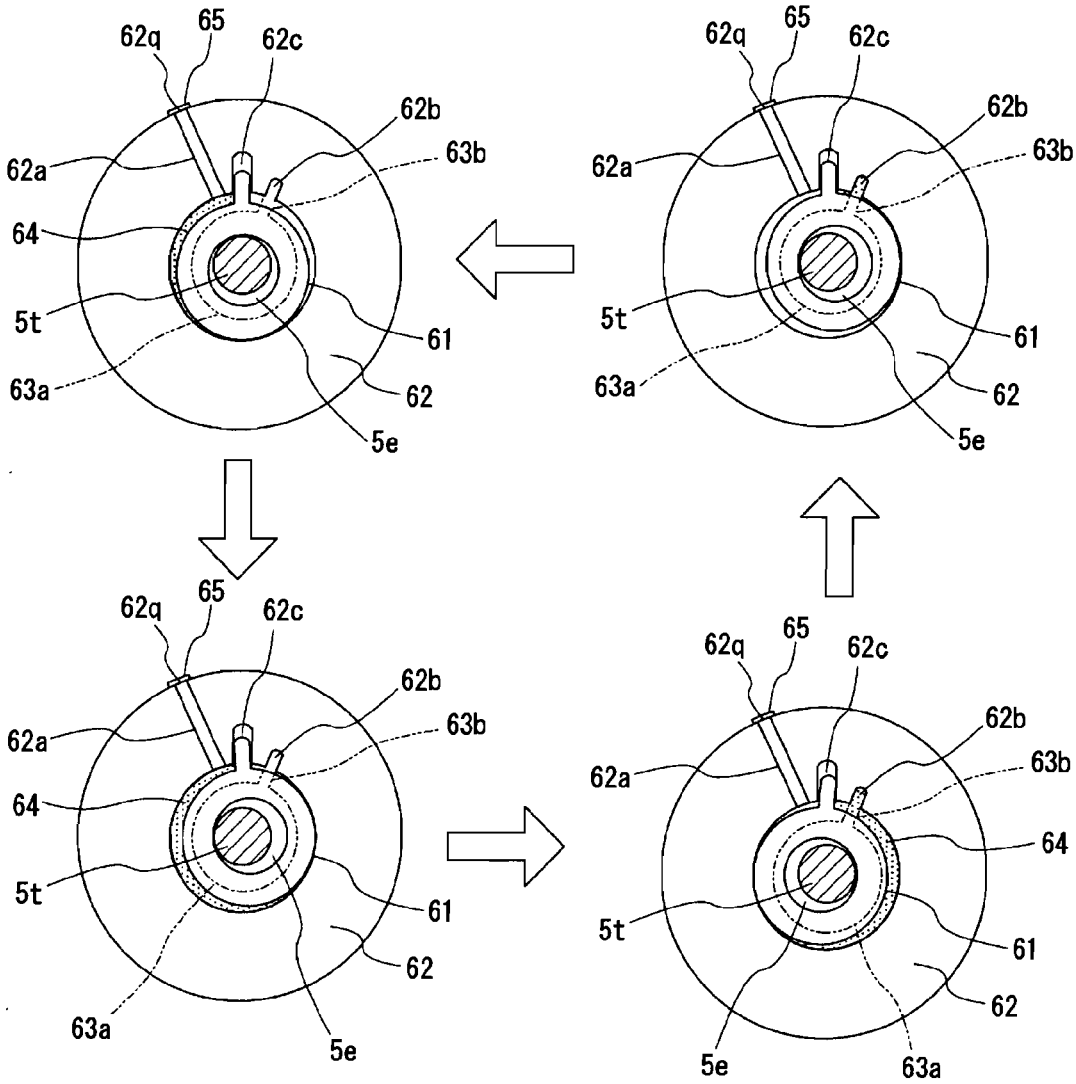
FIG. 4 is a plan view of an oil pump taken along the line IV-IV shown in FIG. 3.

The shaft 5 (the second shaft 5*t*) is provided with an eccentric portion 5*e* at a position slightly below the introduction inlet 29*p*. The oil pump 6 has: a piston 61 that allows the eccentric portion 5*e* of the shaft 5 to be fitted thereinto and performs eccentric motion; a housing 62 (cylinder) accommodating the piston 61; and an introduction member 63 disposed above the housing 62 and the piston 61. As shown in FIG. 4, a crescent-shaped working chamber 64 is formed between the piston 61 and the housing 62. More specifically, the oil pump 6 employs a rotary-type fluid mechanism. As shown in FIG. 4, in the present embodiment, the oil pump 6 has a configuration in which the piston 61 cannot self-rotate. However, the oil pump 6 is not limited as long as it is a positive displacement pump. The oil pump 6 may be another rotary-type pump in which a slide vane is provided and the piston 61 can self-rotate, or may be a gear-type pump such as a trochoid pump.

In the housing 62, there are formed a suction passage 62*a* connecting the upper tank 25*a* of the oil reservoir 25 to the working chamber 64, and an escape portion 62*b* that allows the oil to escape from the working chamber 64. The suction passage 62*a* is in the shape of a groove extending on a straight line along an upper face of the housing 62. A laterally-opened inlet of the suction passage 62*a* forms the above-mentioned oil suction port 62*q*. The suction passage 62*a* may be in the shape of a groove extending along a lower face of the housing 62, or may be formed of a through hole provided in the housing 62. The escape portion 62*b* is in the shape of a groove recessing radially outward from an inner circumferential surface of the housing 62.

The introduction member 63 has the shape of a plate that is squashed in the vertical direction. The shaft 5 penetrates through a center of the introduction member 63. In the introduction member 63, there are formed a circular annular buffer portion 63*a* that surrounds the shaft 5, and a guide portion 63*b* extending from the buffer portion 63*a* to a position corresponding to the escape portion 62*b*, by allowing a specified region of a lower face of the introduction member 63 to be recessed. The escape portion 62 of the housing 62, and the guide portion 63*b* and the buffer portion 63*a* of the introduction member 63 form a discharge passage 67 through which the oil is discharged. The introduction inlet 29*p* of the shaft 5 is provided in a portion of the shaft 5 facing the buffer portion 63*a*, and is opened laterally to the discharge passage 67. The shape and direction of the discharge passage 67 do not necessarily have to be as described above, and can be selected appropriately. Moreover, the number of the inlet 29*p* does not need to be one, either. A plurality of the introduction inlets 29*p* may be provided.

In the oil pump 6 thus configured, when the piston 61 performs eccentric motion in the housing 62 as the second shaft 5*t* rotates, the volumetric capacity of the working chamber 64 increases or decreases accordingly, so that the oil is drawn through the suction passage 62*a* and the oil is discharged through the discharge passage 67. Thereby, the oil is fed into the oil supply passage 29 via the introduction inlet 29*p* and supplied to the compression mechanism 2. Such a mechanism does not convert the rotational motion of the second shaft 5*t* into another motion by a cam mechanism or the like but directly utilizes it as the motion for pumping the oil. Therefore, the mechanism has the advantage that the mechanical loss is small. Moreover, the mechanism is highly reliable because it has a relatively simple structure.

More specifically, as shown in FIG. 3, the introduction member 63 is disposed adjacent to the housing 62 so that the lower face of the introduction member 63 is in contact with the upper face of the housing 62, and the partition member 31 is disposed adjacent to the housing 62 so that an upper face of the partition member 31 is in contact with the lower face of the housing 62. Thereby, the working chamber 64 is closed by the introduction member 63 from the top and is closed by the partition member 31 from the bottom. The piston 61 slides on the partition member 31. The housing 62 may be integrated with the partition member 31, or may be integrated with the introduction member 73.

Furthermore, in the expander-compressor unit 200 of the present embodiment, a strainer 65 is provided to the suction passage 62*a* of the oil pump 6. The strainer 65 is disposed at the inlet 62*q* of the suction passage 62*a* so as to close the inlet 62*q*. The oil to be drawn into the oil pump 6 flows in the suction passage 62*a* after passing through the strainer 65. The strainer 65 is a mesh made of resin or metal, for example. The strainer 65 has a rigidity that prevents the strainer 65 from being deformed because of the oil flow, and reticulation of a level that neither inhibits the oil flow nor allows sludge to pass therethrough. The strainer 65 is fixed to a side face of the housing 62 by bonding with an adhesive, screwing, welding, brazing, or the like.

As described above, in the expander-compressor unit 200 of the present embodiment, the strainer 65 is provided to the suction passage 62*a*, and thus the entry of foreign matters into the oil pump 6 can be prevented. As a result, the oil pump can supply the oil stably and the reliability of the oil pump 6 can be increased.

Moreover, since the strainer 65 is disposed at the inlet 62*q* of the suction passage 62*a*, the oil held in the oil reservoir 25 (in the present embodiment, the oil in the upper tank 25*a*) flows into the suction passage 62*a* via the strainer 65 not only from the direction in which the inlet 62*q* is opened but also from its circumference. Thus, even at the time when the expander-compressor unit 200 starts operating, and the oil has a relatively low temperature and a high viscosity, the oil passes through the strainer 65 smoothly.

MODIFIED EXAMPLE 1

Figure 6:
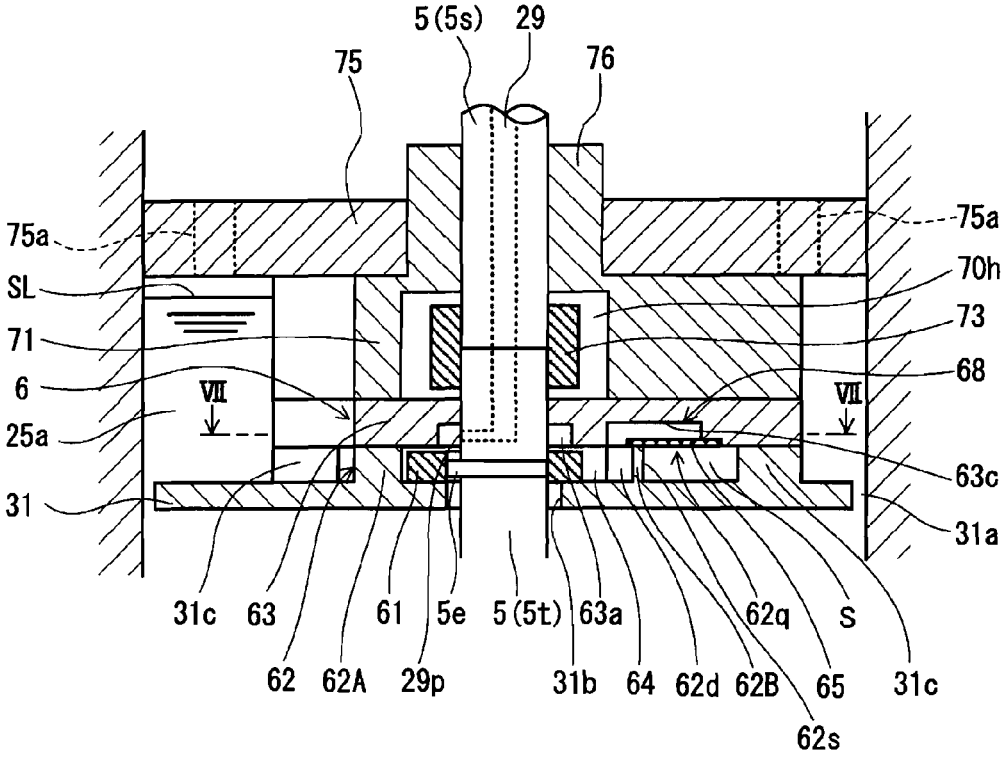
FIG. 6 is a view of an expander-compressor unit according to Modified Example 1, similar to FIG. 3.
Figure 7:
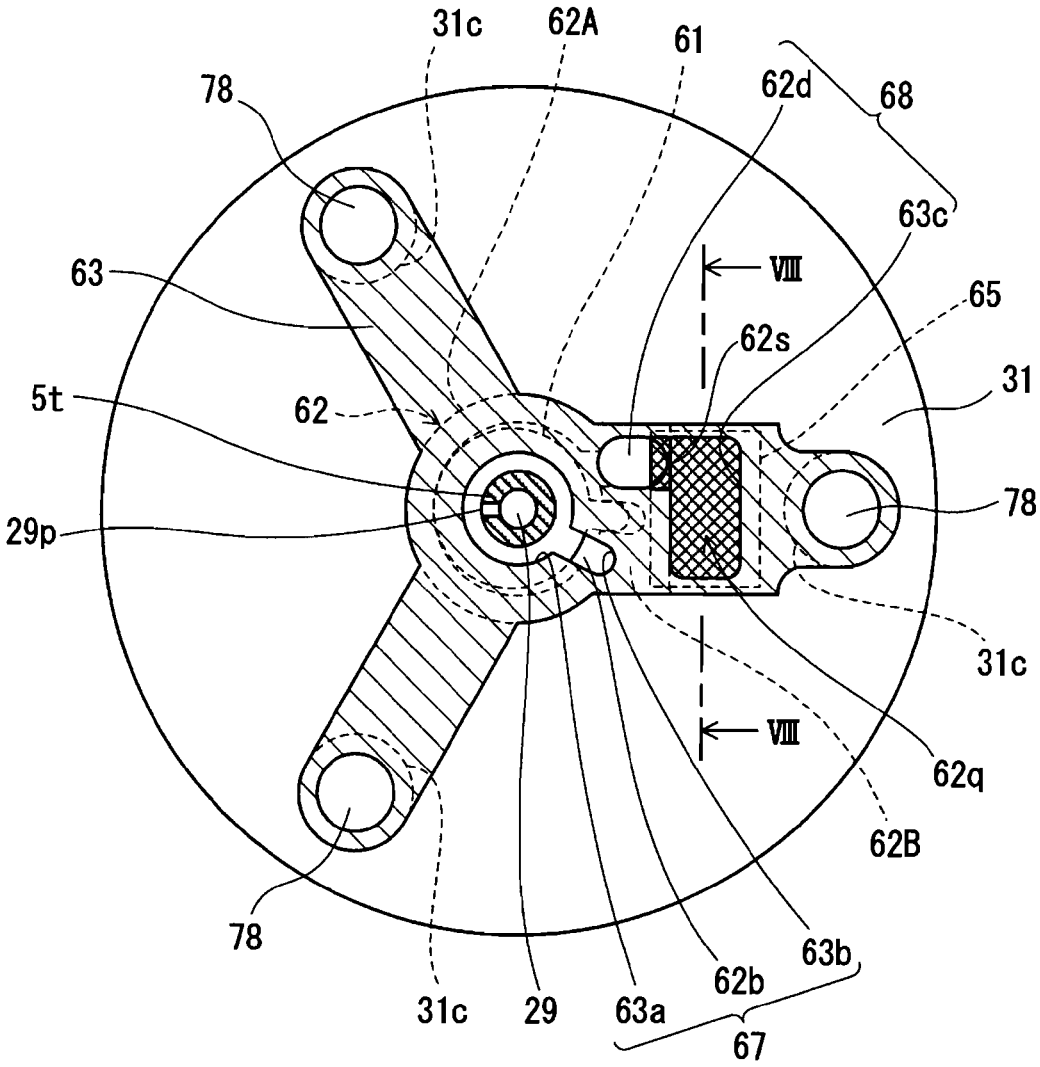
FIG. 7 is a cross-sectional view taken along the line VII-VII in FIG. 6.
Figure 8:
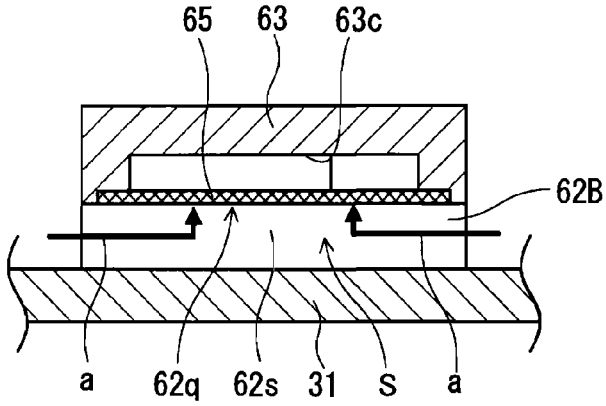
FIG. 8 is a cross-sectional view taken along the line VIII-VIII in FIG. 7.

Although the inlet 62*q* of the suction passage 62*a* in the oil pump 6 is opened laterally and the oil passes through the strainer 65 laterally in the configuration shown in FIG. 3, the inlet 62*q* of the suction passage 68 at which the strainer 65 is disposed may be opened downwardly as in Modified Example 1 shown in FIG. 6 to FIG. 8.

Specifically, in the Modified Example 1 shown in FIG. 6 to FIG. 8, the introduction member 63 of the oil pump 6 approximately is Y-shaped when viewed in plane. The partition member 31 is provided integrally with three boss portions 31*c* that receive three tip end portions of the introduction member 63, respectively. The boss portions 31*c*, the introduction member 63, and the relay member 71 each are provided with an insertion hole 78 that allows a bolt to be inserted therethrough. Via the insertion holes 78, bolts (not shown) are screwed into tapped holes provided in the support frame 75, so that the partition member 31, the introduction member 63, and the relay member 71 are fixed to the support frame 75.

The housing 62 of the oil pump 6 is integrated with the partition member 31. The housing 62 has a circular cylindrical portion 62A that has a specified thickness and surrounds the piston 61, and a projecting portion 62B projecting from the circular cylindrical portion 62A toward one of the boss portions 31*c* (in FIG. 7, the boss portion 31*c* on the right) in a specified width (in the example illustrated, a width equivalent to ¾ of the outer diameter of the circular cylindrical portion 62A). The amount of projection of the projecting portion 62B is set so that a sufficient volume of space S is ensured between a distal end face 62*s* of the projecting portion 62B and the boss portion 31*c* facing the distal end face 62*s*.

In the housing 62, a first suction portion 62*d* for guiding the oil to the working chamber 64 is formed across the circular cylindrical portion 62A and the projecting portion 62B. In a lower face of the introduction member 63, there is formed a second suction portion 63*c* that allows the first suction portion 62*d* to be communicated with the space S facing the distal end face 62*s* of the projecting portion 62B. In order to have a large opening area to the space S, the second suction portion 63*c* has an extended width above the space S, and is approximately L-shaped when viewed in plane. The first suction portion 62*d* and the second suction portion 63*c* form the suction passage 68. A region enclosed by the second suction portion 63*c* and the distal end face 62*s* of the projecting portion 62B when viewed in plane forms the inlet 62*q* of the suction passage 68. The strainer 65 is disposed at the inlet 62*q*.

Specifically, a stepped-down portion into which the strainer 65 can be fitted is formed in the lower face of the introduction member 63, and the strainer 65 is fixed into the stepped-down portion.

When the strainer 65 is disposed at the inlet 62*q* opened downwardly as described above, the oil passes through the strainer 65 from below to above the strainer 65. Thus, foreign matters, such as sludge, removed from the oil by the strainer 65 fall down because of their self weight when the expander-compressor unit 200 stops. As a result, the deposition of foreign matters on the strainer 65 can be prevented.

Moreover, since the strainer 65 is disposed at the inlet 62*q* of the suction passage 68, the oil flows into the suction passage 68 from the circumference of the inlet 62*q* of the suction passage 68 via the strainer 65 as indicated by arrows a in FIG. 8, and the oil passes through the strainer 65 smoothly even when the oil has a low temperature as in the above-mentioned embodiment.

Furthermore, since the inlet 62*q* of the suction passage 68 is opened downwardly, the oil is less likely to flow into the suction passage 68 from an upper side, and the oil present away from the oil level SL is drawn into the oil pump 6 preferentially. Thus, it also is possible to prevent the working fluid from being drawn into the oil pump 6 together with the oil.

MODIFIED EXAMPLE 2

Figure 9:
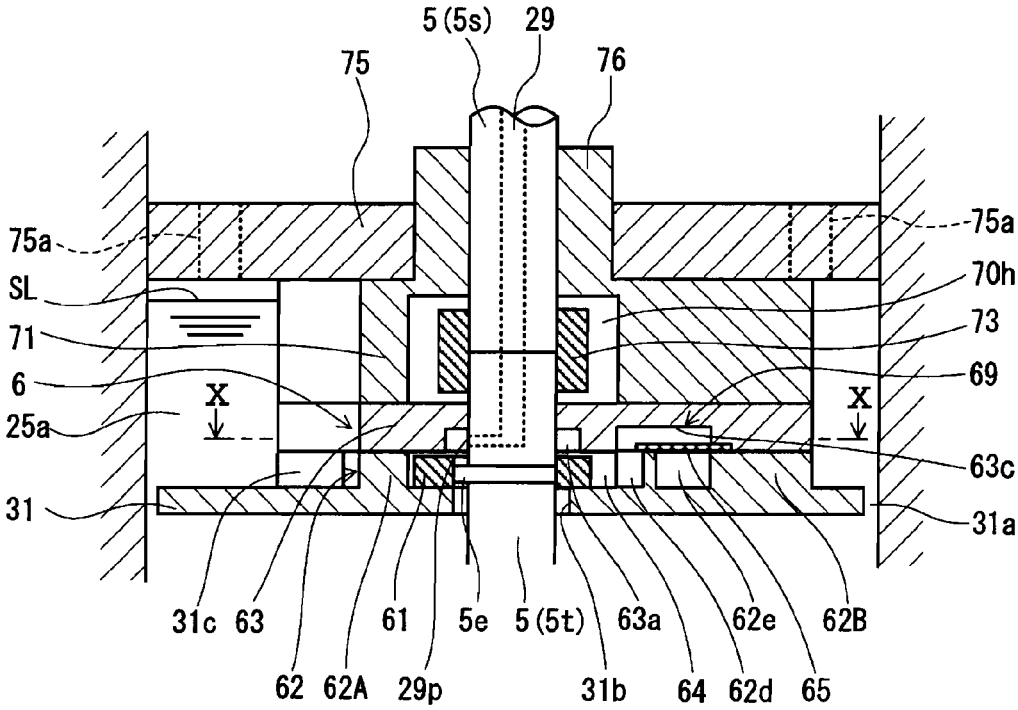
FIG. 9 is a view of an expander-compressor unit according to Modified Example 2, similar to FIG. 3.
Figure 10:
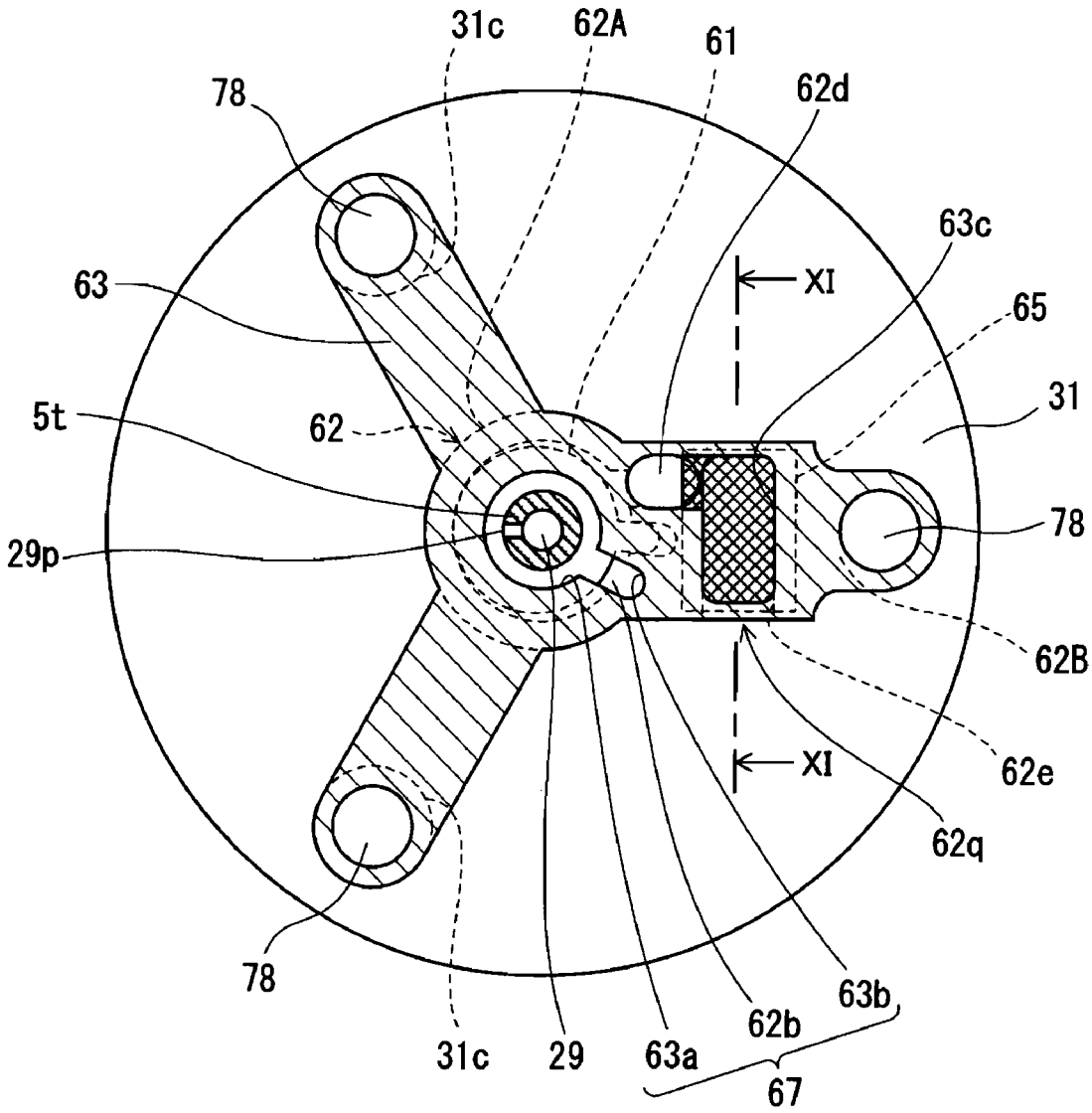
FIG. 10 is a cross-sectional view taken along the line X-X in FIG. 9.
Figure 11:
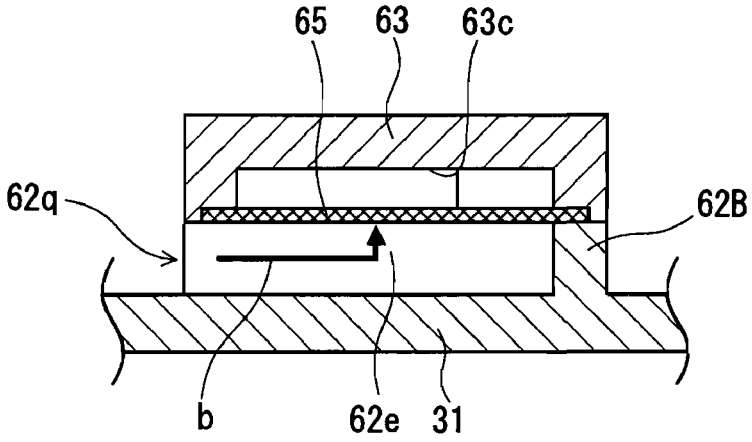
FIG. 11 is a cross-sectional view taken along the line XI-XI in FIG. 10.

The strainer 65 does not need to be disposed at the inlet 62*q* of the suction passage 62*a* of the oil pump 6, and may be disposed at an intermediate point in a suction passage 69 as in Modified Example 2 shown in FIG. 9 to FIG. 11. In this case, the oil to be drawn into the oil pump 6 passes through the strainer 65 while flowing in the suction passage 69. The Modified Example 2 is a slightly changed version of the Modified Example 1 shown in FIG. 6 to FIG. 8.

Specifically, in the Modified Example 2 shown in FIG. 9 to FIG. 11, only two boss portions 31*c* are provided to the partition member 31. The projecting portion 62B of the housing 62 projects to a position corresponding to one of the tip end portions of the introduction member 63 so that the projecting portion 62B can receive the one of the tip end portions of the introduction member 63. Moreover, the insertion hole 78 that allows a bolt to be inserted therethrough is provided also in a distal end portion of the projecting portion 62B. On the other hand, the configuration of the introduction member 63 is completely the same as in the Modified Example 1. That is, the second suction portion 63*c* is formed in the introduction member 63, and the strainer 65 is fixed so as to close an inlet side of the second suction portion 63*c*.

Furthermore, in addition to the first suction portion 62*d*, a third suction portion 62*e* is formed in the projecting portion 62B, at a position corresponding to the extended-width portion of the second suction portion 63*c* formed in the introduction member 63. The third suction portion 62*e* is opened laterally (downwardly in FIG. 10) at a side face of the projecting portion 62B. The first suction portion 62*d* and the third suction portion 62*e* of the projecting portion 62B, and the second suction portion 63*c* of the introduction member 63 form the suction passage 69. The opening of the third suction portion 63*c* forms the inlet 62*q* of the suction passage 69. Moreover, since the strainer 65 is fixed to the introduction member 63 so as to close the inlet side of the second suction portion 63*c*, the strainer 65 is located at an intermediate point in the suction passage 69, more specifically, at a position where the oil flows upwardly in the suction passage 69.

When the strainer 65 is disposed at an intermediate point in the suction passage 69 in this way, the oil passes through the strainer 65 only from one direction as indicated by arrow b in FIG. 11. Thereby, it is possible to remove foreign matters from the oil flowing stably in the suction passage 69.

Since the strainer 65 is located at a position where the oil flows upwardly in the suction passage 69, foreign matters, such as sludge, removed from the oil by the strainer 65 fall down because of their self weights, and the deposition of the foreign matters on the strainer 65 can be prevented as in the Modified Example 1.

In the oil pump 6 according to the above-mentioned embodiment, Modified Example 1, and Modified Example 2, the introduction member 63 is disposed above the housing 62. However, when a housing in the shape of a closed-bottomed vessel opened downwardly is used as the housing 62, the introduction member 63 can be disposed below the housing 62. That is, the introduction inlet 29*p* of the shaft 29 may be located below the eccentric portion 5*e*. It should be noted, however, that when the introduction inlet 29*p* is located above the eccentric portion 5*e*, the oil flowing in the shaft 5 can be kept away from the lower tank 25*b*, and thus the heat transfer from the upper tank 25*a* to the lower tank 25*b* via the shaft 5 can be reduced.

INDUSTRIAL APPLICABILITY

Figure 12:
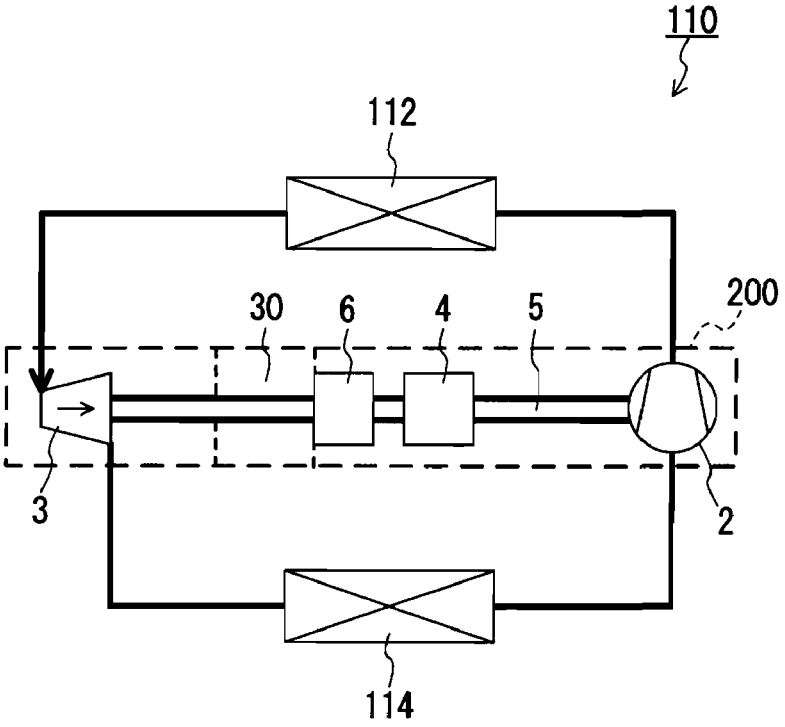
FIG. 12 is a configuration diagram of a heat pump using the expander-compressor unit.
Figure 13:
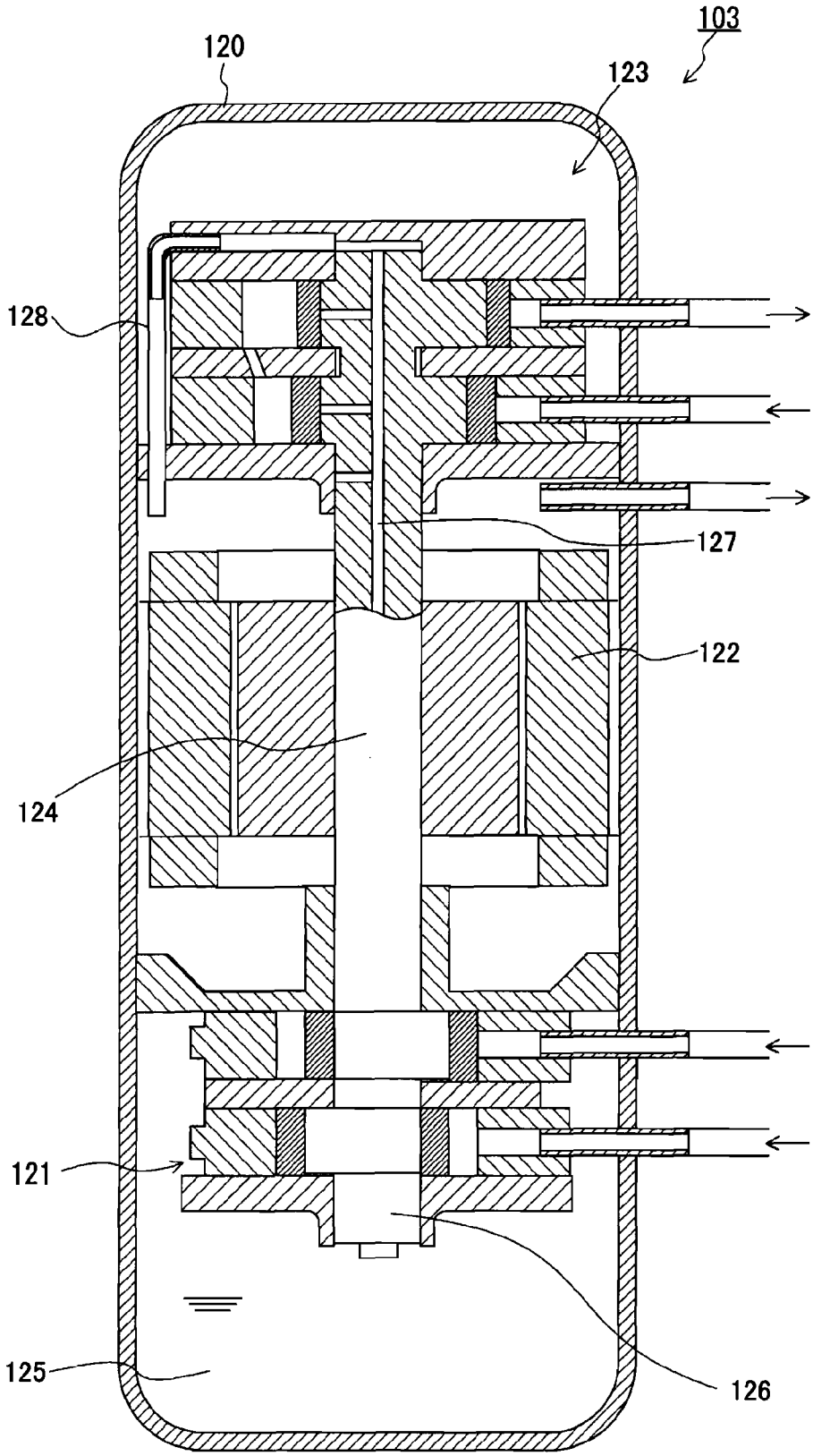
FIG. 13 is a cross-sectional view of a conventional expander-compressor unit.

The expander-compressor unit according to the present invention suitably may be applied to, for example, heat pumps for air conditioners, water heaters, driers, and refrigerator-freezers. As shown in FIG. 12, the heat pump 110 includes the expander-compressor unit 200, a radiator 112 for radiating heat from the refrigerant compressed by the compression mechanism 2, and an evaporator 114 for evaporating the refrigerant expanded by the expansion mechanism 3. The compression mechanism 2, the radiator 112, the expansion mechanism 3, and the evaporator 114 are connected with pipes so as to form a refrigerant circuit. The expander-compressor unit 200 may be replaced by an expander-compressor unit according to another embodiment.

For example, in the case where the heat pump 110 is applied to an air conditioner, suppressing the heat transfer from the compression mechanism 2 to the expansion mechanism 3 can prevent a decrease in the heating capacity due to a decrease in the discharge temperature of the compression mechanism 2 during a heating operation and prevent a decrease in the cooling capacity due to an increase in the discharge temperature of the expansion mechanism 3 during a cooling operation. As a result, the coefficient of performance of the air conditioner is increased.

The invention claimed is:

1. An expander-compressor unit comprising:

a closed casing having a bottom portion utilized as an oil reservoir;

a compression mechanism disposed in the closed casing so as to be located above or below an oil level of an oil held in the oil reservoir;

an expansion mechanism disposed in the closed casing so that a positional relationship of the expansion mechanism with respect to the oil level is vertically opposite to that of the compression mechanism;

a shaft coupling the compression mechanism to the expansion mechanism;

an oil pump disposed between the compression mechanism and the expansion mechanism and configured to draw the oil held in the oil reservoir via a suction passage and supply the oil to one of the compression mechanism and the expansion mechanism that is located above the oil level; and a strainer provided to the suction passage so that the oil to be drawn into the oil pump passes through the strainer.

2. The expander-compressor unit according to claim 1, wherein the compression mechanism is located above the oil level and the expansion mechanism is located below the oil level.

3. The expander-compressor unit according to claim 2, wherein the compression mechanism is a scroll-type mechanism and the expansion mechanism is a rotary-type mechanism.

4. The expander-compressor unit according to claim 2, wherein an oil supply passage leading to sliding parts of the compression mechanism is formed in the shaft, and the oil is fed into the oil supply passage from the oil pump.

5. The expander-compressor unit according to claim 1, wherein the strainer is disposed at an intermediate point in the suction passage.

6. The expander-compressor unit according to claim 5, wherein the strainer is located at a position where the oil flows upwardly in the suction passage.

7. The expander-compressor unit according to claim 1, wherein the strainer is disposed at an inlet of the suction passage.

8. The expander-compressor unit according to claim 7, wherein the inlet of the suction passage is opened downwardly.

* * * * *